United States Patent [19]

Stern et al.

[11] Patent Number: 4,479,332

[45] Date of Patent: Oct. 30, 1984

[54] LENS BLOCKER AND METHOD

[75] Inventors: Theodore J. Stern, Woodland Hills, Calif.; Larry A. Beachler, Vincennes, Ind.

[73] Assignee: AIT Industries, Inc., Schaumburg, Ill.

[21] Appl. No.: 418,750

[22] Filed: Sep. 16, 1982

[51] Int. Cl.[3] ..... B24B 9/14; B24B 1/00; B24B 13/00

[52] U.S. Cl. ..... 51/277; 51/284 E; 33/174 A; 279/1 M

[58] Field of Search ..... 51/277, 262, 284 E; 279/1 M; 33/174 A

[56] References Cited

U.S. PATENT DOCUMENTS 2,620,731 12/1952 Slonneger ..... 279/1 M
4,138,085 2/1979 Bicskei ..... 51/277
4,227,349 10/1980 Bicskei ..... 51/284 E
4,229,911 10/1980 Bicskei ..... 51/284 E

*Primary Examiner*—Roscoe V. Parker
*Attorney, Agent, or Firm*—Gary, Juettner & Pyle

[57] ABSTRACT

An improved method and apparatus for blocking semi-finished lenses by the adjustment of each such lens until it occupies a prescribed position where an alloy hub or "block" is removable affixed to the lens by an adhesive pad so that the lens can be held for finishing, is characterized by magnetically securing the block to a chuck for carrying and affixing the block to the lens. The block may quickly and simply be secured to the chuck merely by being extended therein without the need for any mechanical devices, and upon being affixed to the lens is readily separable from the chuck upon withdrawal of the chuck therefrom.

16 Claims, 3 Drawing Figures

20
52
34
42
48
50
44
56
46
26
38
40
36
30
28
24
22
54
58
32

LENS BLOCKER AND METHOD

BACKGROUND OF THE INVENTION

The present invention relates to methods of and apparatus for blocking lenses, and in particular to an improved method of and apparatus for applying a block to the surface of a lens to permit alteration of the lens.

Alteration of lenses includes both generating surfaces on lenses to impart specific optical properties thereto, and grinding or edging the peripheries of lenses to a predetermined outline. Surface generation commonly involves a series of steps. For example, the optical center, and optionally the cylinder axis, of a lens blank are located and marked on one face thereof. Next, a lens block is attached to the lens such that the optical center and cylinder axis of the lens are aligned with the center point and cylinder axis of the block. The desired optical properties are then generated upon the unfinished face of the lens by grinding the lens while supporting the same by means of the block.

Edging a lens to a desired peripheral outline involves a series of similar steps. For example, the optical center, and optionally the cylinder axis, of the lens are located. Next, a lens block is attached to the lens such that the optical center and cylinder axis of the lens are aligned with the center point and cylinder axis of the block. The lens and block are then gripped by a work holder of a lens edging machine, and the periphery of the lens is ground to a desired shape.

Whether a lens is to be surface finished or edged, machines for applying a lens block to the lens are well known in the art and referred to as "lens blockers". In use of such machines a lens block, which may carry an adhesive pad for being pressed against a lens to secure the block to the lens, is carried in a chuck of the machine. The lens is placed on the machine and, by means of targets and reference marks, is accurately visually aligned with its optical center and cylinder axis in a predetermined relationship with the center point and cylinder axis of the block. The block and lens are then moved together, either by moving the block against the lens or vice versa, to attach the block to the lens.

In a common arrangement, the lens is supported on a horizontal surface of the machine and the chuck is above the lens with the block extending downwardly therefrom. To prevent the block from falling out of the chuck, and yet to permit its release when it is affixed to the lens, it must be releasably retained by the chuck. Heretofore releasable mechanical retaining means have been employed, which have necessitated a relatively time consuming and dexterious manipulation of the block to position it in the chuck, both in order to accommodate the retaining means and by virtue of the fact that in conventional lens blockers, only a small spacing ordinarily exists between the chuck and the surface for supporting the lens. Lens blockers illustrative of the state of the art and having mechanical retaining means associated with the chucks thereof are illustrated in U.S. Pat. Nos. 4,227,349 and 4,229,911, issued to Bela J. Bicskei on Oct. 14, 1980 and Oct. 28, 1980, respectively.

OBJECTS OF THE INVENTION

An object of the present invention is to provide a lens blocking machine having improved means for releasably retaining a lens block in a chuck thereof for application onto a lens to be altered.

Another object is to provide an improved lens blocking machine wherein a chuck thereof for a lens block is movable between a lens blocking position and a position accommodating convenient placement of the block in the chuck.

SUMMARY OF THE INVENTION

In accordance with the present invention, there is provided an improved lens blocker for bringing an adhesive bearing lens block into contact with a lens to adhesively affix said block to the lens, which comprises a support for the lens; a chuck for said block; means for releasably securing said block to said chuck; and means for moving said support and chuck relative to each other to move the same toward each other to bring said block into contact with and to adhesively affix said block to the lens, and then away from each other to release said block from said chuck, wherein the improvement is characterized in that said means for releasably securing comprises means for magnetically securing said block to said chuck.

The invention also contemplates an improved lens blocker for bringing an adhesive bearing lens block into contact with a lens to adhesively affix said block to the lens, which comprises a support for the lens; a chuck for said block; means for releasably securing said block to said chuck; and means for moving said support and chuck relative to each other to move the same toward each other to bring said block into contact with and to adhesively affix said block to the lens, and then away from each other to release said block from said chuck, wherein the improvement comprises means for pivotally mounting said chuck for movement between a first position whereat a surface of said chuck for receiving said block extends forwardly of said lens blocker to facilitate securing said block thereto and a second position whereat said block receiving surface and said block extend toward the lens, and said moving means moves said pivotally mounting means and said support relative to each other when said chuck is in said second position.

There is also provided, in accordance with one method of the invention, an improved method of blocking a lens, which comprises the steps of supporting a lens on an instrument; releasably securing an adhesive bearing lens block to a chuck; and moving the chuck and lens relative to each other to move the same toward each other to bring the block into contact with and to adhesively affix the block to the lens, and then away from each other to release the block from the chuck, wherein the improvement is characterized in that the step of releasably securing comprises magnetically securing the block to the chuck.

In addition, pursuant to another method of the invention, an improved method of blocking a lens comprises the steps of supporting a lens on an instrument; releasably securing an adhesive bearing lens block to a chuck; and moving the chuck and lens relative to each other to move the same toward each other to bring the block into contact with and to adhesively affix the block to the lens, and then away from each other to release the block from the chuck, wherein the improvement comprises the step, prior to the step of moving the chuck and lens relative to each other, of pivoting the chuck between a first position whereat a surface thereof for receiving the block extends forwardly of the instrument to facilitate securing the block thereto and a second position whereat the block receiving surface of the chuck and the block extend toward the lens.

The foregoing and other objects, advantages and features of the invention will become apparent upon a consideration of the following detailed description, when taken in conjunction with the accompanying drawings.

DETAILED DESCRIPTION

Figure 1:
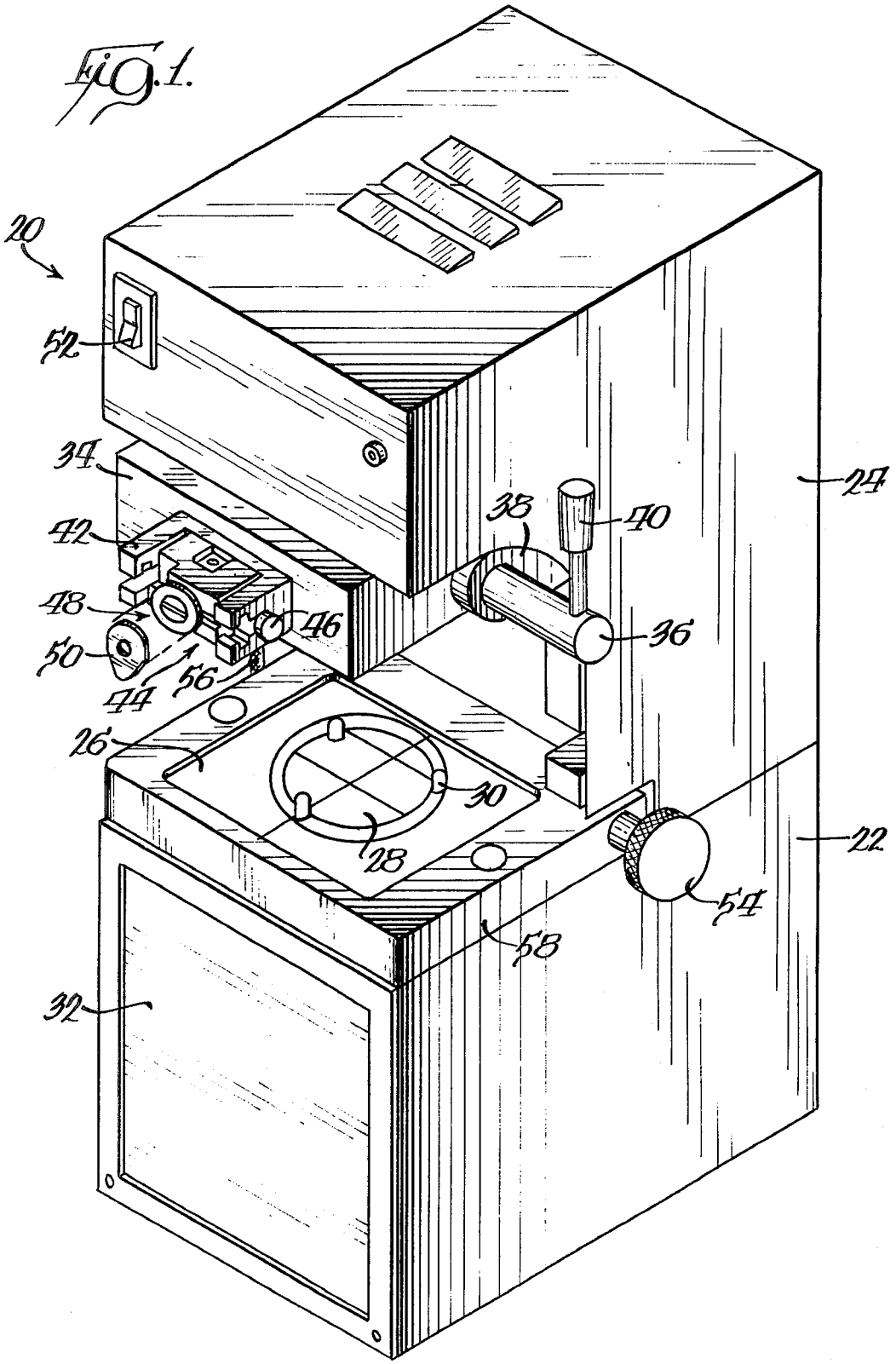
FIG. 1 a perspective view of a lens blocking machine of a type in which the teachings of the present invention advantageously be incorporated.

Referring to FIG. 1, there is indicated generally at 20 a lens blocking machine or lens blocker, of a type in which the teachings of the present invention may advantageously be incorporated. The lens blocker includes a base portion 22 and an upper housing 24. Mounted atop an upper surface of the base portion at a forward end thereof is a plate 26, at least a center portion 28 of which is transparent, and three posts 30 extend upwardly from the plate in spaced relationship around the center portion for supporting on their upper ends an ophthalmic lens (not shown). Although also not shown, contained within the upper housing 24 is a source of light which is directed by lenses through targets and then downwardly through the center portion of the lens supporting plate, and a mirror is mounted at an incline within the base to reflect the light passing through the center portion onto a viewing screen 32 on a front face of the base, whereby an image of the targets is projected onto the screen.

The lens blocker is for applying a lens block onto a surface of a lens supported on the posts 30, and to that end includes a chuck mechanism for releasably carrying a lens block. The mechanism includes a chuck support plate 34 rotatably carried beneath the forward upper end of the upper housing 24 by means of a pair of rods 36 (only one shown in FIG. 1) mounted for rotation within a pair of brackets 38, at least one of the rods having a handle 40 for rotation of the mechanism. Carried on an end of the support plate is a chuck mount 42 which is generally in the form of a U-shaped member, and supported within the mount is a chuck, indicated generally at 44. The chuck may be secured within or removed from the mount by means of a thumb screw 46 which passes through the mount and into a threaded passage in the side of the chuck, and the chuck is adapted to receive and releasably hold a lens block, indicated generally at 48, having an adhesive pad 50 on its lower surface. The adhesive pad, which releasably affixes the block to a lens, may be of the type disclosed in U.S. Pat. No. 3,962,833, issued to Dee Lynn Johnson on June 15, 1976, and assigned to Minnesota Mining and Manufacturing Co. The chuck mechanism is rotatable between the position as shown, whereat the mechanism is horizontal and the chuck 44 extends forwardly of the machine for ease in placing the block 48 thereon, and a position 90° therefrom whereat the mechanism is vertical and the chuck extends downardly over a lens to which the block is to be applied, and a stop (not shown) limits rotation of the mechanism to between its two positions.

In use of the lens blocker to apply a block onto a lens, the block 48 carrying the adhesive pad 50 is inserted into the chuck 44 and a lens, to which has previously been applied in a manner well known in the art a marking representative of its optical center and cylindrical axis, is placed on the posts 30. With the machine on and the light source energized as controlled by a switch 52, an image of the target and the marking on the lens are then projected onto the viewing screen 32. The position of the mark with respect to the target as viewed on the screen is representative of the orientation of the optical center and cylinder axis of the lens with respect to the center and cylinder axis of the block when the chuck mechanism is rotated to the vertical position and the block is affixed to the lens. Thus, to precisely orient the lens for application of the block thereon, a pair of adjustment knobs 54 and 56 are rotated to move a lens plate support 58 with respect to the base portion 22 until the mark on the lens is in a predetermined relationship with the target as viewed on the screen. The chuck mechanism is then rotated to its vertical position, at which point the optical center and cylinder axis of the lens are properly oriented with respect to the center and cylinder axis of the block, and the chuck mechanism is moved vertically downward to bring the block against and adhere the block to the lens by means of the adhesive pad. Any convenient means, either manually or automatically operated, may be used to move the chuck mechanism toward and away from the lens, it being understood that the block is releasably secured to the chuck, so that upon return of the chuck mechanism to its upper position, the block remains affixed to the lens.

Figure 2:
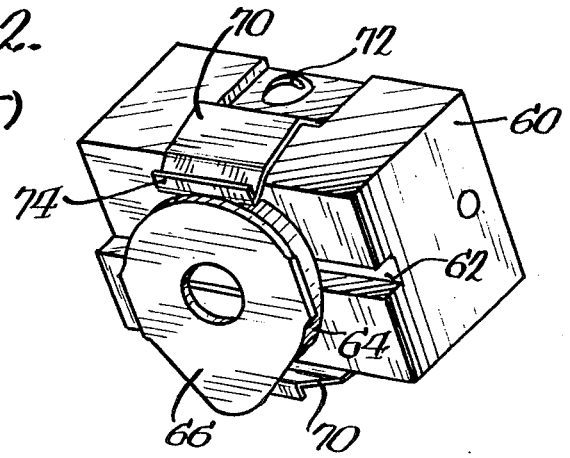
Fig. 2. (PRIOR ART)
FIG. 2 is a perspective view of a prior art chuck for a lens blocker and a lens block retained thereby, illustrating a typical mechanical structure contemplated by the art for releasably retaining the block on the chuck.

Except for the feature of rotating the chuck mechanism between a horizontal position whereat the chuck extends forwardly of the lens blocker for ease of application of a lens block thereon, and a vertical position for application of the block on a lens, to the extent described the lens blocker is known in the art, and FIG. 2 illustrates a prior art chuck of a type as might conventionally be used therewith. As is seen, the chuck comprises a main body 60 having a channel 62 therein into which a lens block 64 carrying an adhesive pad 66 is received. To releasably retain the block on the chuck, a pair of spring clips 70 are affixed to opposite sides thereof by fasteners 72, and have U-shaped ends which face each other at a point beyond the block receiving surface of the chuck. The unexpanded spacing between the ends of the spring clips is less than the dimension of the lens block therebetween when the block is on the chuck, whereby extension of the block into the channel extends the ends of the spring clips apart so that the clips retain the block in the chuck, but release the block from the chuck after it has been applied on a lens.

Two difficulties are encountered with conventional lens blockers using conventional chucks. First, because a mechanical mechanism retains the block on the chuck, mounting the block on the chuck is cumbersome. When the retaining means comprises spring clips as shown, the clips must be stiff and their ends close together so that sufficient retention forces will be applied to the block, which leads to difficulty in placing the block between the clips, and with other types of mechanical retaining means, additional steps are required to manipulate the retaining means incident to insertion of the block into the chuck, all of which is time consuming and adds complexity to the operation. Secondly, because with conventional lens blockers the chuck mechanism is not rotatable, but instead is normally fixed in a vertical portion with the chuck closely spaced from the lens even when the mechanism is in its upper position, it is difficult if not impossible to view the chuck during mounting of the block and only a very limited space is available for an operator's hands during mounting, which further hinders the block mounting process.

Figure 3:
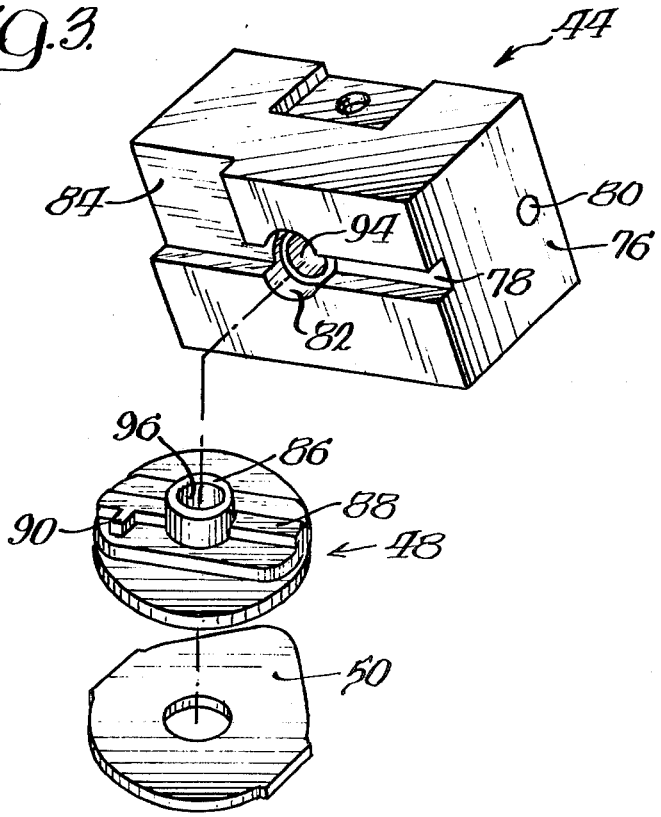
FIG. 3 is a perspective assembly view of a lens block and a chuck for a lens blocker, which incorporate the teachings of the present invention to facilitate convenient releasable retention of the block by the chuck.

Accordingly, in improving upon the prior art, in addition to providing a chuck mechanism for a lens blocker which is rotatable to a position accommodating convenient mounting of a block on a chuck, the invention also contemplates an improved chuck and lens block arrangement which does not require any mechanical means whatsoever for releasably retaining the block on the chuck. As shown in FIG. 3, the chuck 44 of the invention comprises a body 76 having a channel 78 formed therein and a passage 80 for reception of the thumb screw 46. A center portion 82 of the channel is enlarged and generally circular, and to one side of center the channel is opened to define a cut out area 84. The lens block 48 is received in the channel and center opening of the chuck, and to ensure proper orientation therein the block has an elevated annular portion 86 for entry into the center portion 82 of the chuck, a ridge 88 for entry into the channel in the chuck and a tab 90 for entry into the cut out area 84.

Without more, if the block were placed on the chuck, it would simply fall off when the chuck mechanism was rotated to its vertical position. Therefore, to releasably retain the block on the chuck, the invention contemplates that one or both be provided with a magnet, such for example as a magnet 94 within the center portion 82 of the chuck and/or a magnet 96 within the annular portion 86 of the block. In the case where one of the chuck and block is of a nonmagnetically permeable material and the other of a magnetically permeable material, a magnet may be provided on only the one. On the other hand, if neither of the chuck and block is of a magnetically permeable material, or if one or both are and it is desired to increase the force retaining the block on the chuck, then both the chuck and the block may be provided with magnets, it being understood that in such a case the magnets would be arranged so that opposite magnetic pole faces are presented to each other when the block is placed on the chuck.

Thus, the invention also provides improved means for releasably retaining a lens block on a chuck, which does not rely upon any mechanical mechanism whatsoever. Consequently, the block may readily be placed on the chuck with only minimum manual manipulation, and when the block is adhered to a lens by the adhesive pad 50, it may readily be removed from the chuck with only a force necessary to overcome the magnetic attraction between the chuck and block.

While embodiments of the invention have been described in detail, various modifications and other embodiments thereof may be devised by one skilled in the art without departing from the spirit and scope of the invention, as defined in the appended claims.

What is claimed is:

1. An improved lens blocker for bringing an adhesive bearing lens block into contact with a lens to adhesively affix said block to the lens, comprising a support for the lens; a chuck for said block; means for releasably securing said block to said chuck; and means for moving said support and chuck relative to each other to move the same toward each other to bring said block into contact with and to adhesively affix said block to the lens, and then away from each other to accommodate release of said block from said chuck, the improvement characterized in that said means for releasably securing comprises means for magnetically securing said block to said chuck.

2. An improved lens blocker as in claim 1, wherein said block is of a magnetically permeable material and said means for magnetically securing comprises magnet means associated with said chuck.

3. An improved lens blocker as in claim 1, wherein said chuck is of a magnetically permeable material and said means for magnetically securing comprises magnet means associated with said block.

4. An improved lens blocker as in claim 1, wherein said means for magnetically securing comprises first magnet means associated with said chuck and second magnet means associated with said block, said first and second magnet means presenting opposite magnetic poles to each other when said block is secured to said chuck.

5. An improved lens blocker as in claim 1, further comprising means for moving said support to position the lens in a prescribed optical condition prior to adhesively affixing said block thereto.

6. An improved lens blocker as in claim 5, wherein said block has a center and a cylinder axis and said means for moving said support positions the lens with its optical center and cylinder axis, if any, in alignment with the center and cylinder axis of said block prior to adhesively affixing said block thereto.

7. An improved lens blocker for bringing an adhesive bearing lens block into contact with a lens to adhesively affix said block to the lens, comprising a support for holding the lens in a generally horizontal plane; a chuck for said block; means for releasably securing said block to said chuck; means for moving said support and chuck relative to each other to move the same toward each other to bring said block into contact with and to adhesively affix said block to the lens, and then away from each other to accommodate release of said block from said chuck; and means for pivotally mounting said chuck above said support for movement between a first position whereat a surface of said chuck for receiving said block extends forwardly of said lens blocker to facilitate securing said block thereto and a second position whereat said block receiving surface and said block extend downwardly above the lens, said means for moving said chuck and said support relative to each other moving the same when said chuck is in said second position, the improvement being characterized in that said means for releasably securing comprises means for magnetically securing said block to said chuck.

8. An improved lens blocker as in claim 7, wherein said means for moving moves said chuck toward and away from said support.

9. An improved method of blocking a lens, comprising the steps of: supporting a lens on an instrument; releasably securing an adhesive bearing lens block to a chuck; and moving the chuck and instrument relative to each other to move the same toward each other to bring the block into contact with and to adhesively affix the block to the lens, and then away from each other to accommodate release of the block from the chuck, the improvement characterized in that the step of releasably securing comprises magnetically securing the block to the chuck.

10. An improved method as in claim 9, wherein the block is of a magnetically permeable material and said step of magnetically securing comprises providing a magnet in the chuck.

11. An improved method as in claim 9, wherein the chuck is of a magnetically permeable material and said step of magnetically securing comprises providing a magnet in the block.

12. An improved method as in claim 9, wherein said step of magnetically securing comprises providing a magnet in the chuck and a magnet in the block with the magnets presenting opposite magnetic pole faces to each other when the block is secured to the chuck.

13. An improved method as in claim 9, including the step of positioning the lens in a prescribed optical condition prior to adhesively affixing the block thereto.

14. An improved method as in claim 13, wherein the block has a center and a cylinder axis and said positioning step comprises positioning the lens with its optical center and cylinder axis, if any, in alignment with the center and cylinder axis of the block prior to adhesively affixing the block thereto.

15. An improved method of blocking a lens, comprising the steps of: supporting a lens in a generally horizontal plane on an instrument; releasably securing an adhesive bearing lens block to a chuck; moving the chuck and lens relative to each other to move the same toward each other to bring the block into contact with and to adhesively affix the block to the lens, and then away from each other to release the block from the chuck; and, prior to moving the chuck and lens relative to each other, pivoting the chuck between a first position whereat a surface thereof for receiving the block extends forwardly of the instrument to facilitate securing the block thereto and a second position whereat the block receiving surface of the chuck and the block extend downwardly above the lens, the improvement being characterized in that the step of releasably securing comprises magnetically securing the block to the chuck.

16. A method as in claim 15, wherein said moving step comprises moving the chuck toward and away from the lens.

* * * * *